US011825936B1

(12) United States Patent
Powell

(10) Patent No.: US 11,825,936 B1
(45) Date of Patent: Nov. 28, 2023

(54) COLLAPSIBLE TABLE

(71) Applicant: Kinematic Sports, LLC, Tuscaloosa, AL (US)

(72) Inventor: Patrick Powell, Pelham, AL (US)

(73) Assignee: KINEMATIC SPORTS, LLC, Pelham, AL (US)

( * ) Notice: Subject to any disclaimer, the term of this patent is extended or adjusted under 35 U.S.C. 154(b) by 0 days.

(21) Appl. No.: 17/589,506

(22) Filed: Jan. 31, 2022

(51) Int. Cl.
*A47B 1/04* (2006.01)
*A47B 3/08* (2006.01)

(52) U.S. Cl.
CPC ..... *A47B 1/04* (2013.01); *A47B 3/08* (2013.01); *A47B 2200/12* (2013.01)

(58) Field of Classification Search
CPC ... A47B 1/04; A47B 3/08; A47B 3/091–0918; A47B 2200/12
See application file for complete search history.

(56) References Cited

U.S. PATENT DOCUMENTS

| | | | | |
|---|---|---|---|---|
| 5,224,531 | A | 7/1993 | Blohm | |
| 5,509,361 | A * | 4/1996 | Chen | A47B 3/0912 403/231 |
| 5,536,034 | A | 7/1996 | Miller | |
| 6,422,567 | B1 * | 7/2002 | Mastrangelo | B60R 7/02 410/67 |
| 7,188,843 | B2 | 3/2007 | Magness | |
| 7,445,216 | B1 | 11/2008 | Chou | |
| 7,513,511 | B2 | 4/2009 | Chaseateau | |
| 7,588,255 | B2 | 9/2009 | Katz | |
| 7,726,669 | B2 | 6/2010 | Alexander | |
| 8,596,671 | B2 | 12/2013 | Myrant et al. | |
| 8,770,597 | B1 | 7/2014 | Phillips | |
| 9,050,992 | B2 | 6/2015 | Smith | |
| 2007/0216116 | A1 | 9/2007 | Gallea et al. | |
| 2010/0032927 | A1 | 2/2010 | Gordon | |

(Continued)

FOREIGN PATENT DOCUMENTS

| | | | | |
|---|---|---|---|---|
| DE | 202005009275 U1 | | 8/2005 | |
| GB | 2577507 A | * | 4/2020 | A47B 1/04 |
| KR | 20160109740 A | * | 9/2016 | |

OTHER PUBLICATIONS

Industrialsupplies.com, Wesco 4-in-1 Convertible Hand Truck, https://www.industrialsupplies.com/p/carts-trucks/hand-trucks/convertible-hand-trucks/wesco-multi-function-office-caddy-convertible-hand-truck-98778610/25/2021.

(Continued)

*Primary Examiner* — Matthew W Ing
(74) *Attorney, Agent, or Firm* — C. Brandon Browning; Ilya S. Mirov; Maynard Nexsen PC

(57) ABSTRACT

The present disclosure document is directed to an extendable, collapsible table. The table includes a table top with at least one pair of legs extending pivotably from its underside and at least one pair of extension panels. The extension panels are configured to be attached as shelves to slots on vertical table edges or on the horizontal table top face, or configured to be stored in slots on bars between the pairs of legs. For transport, the pairs of legs, with or without stored extension panels, are pivotably retracted. A user pulls a handgrip near one side of the table top to roll the transportable system using at least one wheel near an opposite side of the table top. The transportable system operates as a dolly when one extension panel is coupled to the horizontal table top face in a location nearest the at least one wheel.

20 Claims, 8 Drawing Sheets

(56) References Cited

U.S. PATENT DOCUMENTS

| | | | | |
|---|---|---|---|---|
| 2013/0341878 | A1 | 12/2013 | Harris et al. | |
| 2020/0307665 | A1 | 10/2020 | Su | |
| 2021/0212451 | A1* | 7/2021 | Bergsma | A47B 13/02 |

OTHER PUBLICATIONS

Hand Trucks 'R' US, Roughneck 5-in-1 Convertible Hand Truck, https://www.handtrucksrus.com/product-details.aspx?id=932, Oct. 25, 2021.

* cited by examiner

COLLAPSIBLE TABLE

TECHNICAL FIELD

The present invention is directed to an extendable, collapsible table and methods of using same.

BACKGROUND OF INVENTION

Multi-purpose tables are often used for a variety of activities, both in outdoor and indoor environments. For example, a table may be transported to a sideline of a sports field or other outdoor location to hold or display equipment, refreshments, or other activity-related items for athletes or athletic management personnel. Thus, an ideal multi-purpose table is easily transportable, sturdy, and customizable to fit the needs of the user or users.

One way to facilitate transportation of a table is to provide wheels on the table legs. However, these wheeled tables still occupy a large amount of storage space when moved to a transport vehicle or storage location. Some tables include collapsible features, allowing the table to be rearranged to occupy a smaller space for storage. Collapsible tables may also include wheels on locations that, in their collapsed configurations, allow for wheeled transport of the table.

Multi-purpose tables may also include features or components that increase, decrease, or rearrange useable surface area or boundaries of the table. For example, foldable sidewalls may be pivoted to raise or lower the sides of a table, such that the surface area of the table top may be selectively increased or decreased. In these table systems, however, the locations of customization are fixed, and the pivotable sidewalls may impede compact transport and storage. The present disclosure is directed to a collapsible multi-purpose table with detachable extension panels, such that the table is both customizable and easily transportable.

SUMMARY OF THE INVENTION

The present invention is directed to a collapsible multi-purpose table. In one aspect of the invention, there is provided a collapsible table system. The system includes a collapsible table with a table top and at least one pair of legs pivotably extending from an underside of the table top. The system further includes at least one extension panel configured to be detachably stored between the at least one pair of legs when the extension panel is not in use as a shelf. The at least one extension panel is configured to be detachably coupled to at least one vertical table edge of the table top in a horizontal orientation as a shelf. Further, the at least one extension panel is configured to be detachably coupled to a horizontal table top face in a vertical orientation as a shelf. The collapsible table system is configured to operate as a table when the at least one pair of legs is extended and configured to operate as a transport system when the at least one pair of legs is retracted.

In some embodiments, the at least one extension panel includes at least one extrusion extending from the at least one extension panel. In some instances, the at least one pair of legs includes a horizontal storage bar extending between the at least one pair of legs and having at least one storage slot, where each storage slot is configured to receive one extrusion of the at least one extension panel. The at least one extension panel is detachably stored between the at least one pair of legs when each extrusion is received within one storage slot. In some instances, the at least one vertical edge of the table top includes at least one attachment slot, where each attachment slot is configured to receive one extrusion of the at least one extension panel. The at least one extension panel is detachably coupled to the at least one vertical table edge in the horizontal orientation when each extrusion is received within one attachment slot. In some instances, the horizontal table top face includes at least one attachment slot, where each attachment slot is configured to receive one extrusion of the at least one extension panel. The at least one extension panel is detachably coupled to the horizontal table top face in the vertical orientation when each extrusion is received within one attachment slot.

In some embodiments, the table top includes a handgrip on its horizontal table top face and at least one wheel extending horizontally from a first vertical table edge. The handgrip is located near a second vertical table edge that is parallel to the first vertical table edge. In some instances, the at least one wheel is configured to roll the collapsible table system along a surface when collapsible table system is operated as the transport system and a user pulls the handgrip. In some instances, the collapsible table system is configured to operate as a dolly transport system when the at least one pair of legs is retracted and the at least one extension panel is detachably coupled to the horizontal table top surface. In some instances, a first extension panel is configured to be detachably coupled to a first vertical table edge and a second extension panel is configured to be detachably coupled to a second vertical table edge. In some instances, a first extension panel and a second extension panel are configured to be detachably coupled to a first vertical table edge. In some instances, a first extension panel is configured to be detachably coupled to a first vertical table edge and a second extension panel is configured to be detachably coupled to the horizontal table top face.

In another aspect of the present disclosure, there is provided a collapsible table system. The system includes a collapsible table with a table top and at least one pair of legs pivotably extending from an underside of the table top. The at least one pair of legs includes a horizontal storage bar extending between the at least one pair of legs. The system further includes at least one extension panel configured to be detachably stored on the horizontal storage bar between the at least one pair of legs. The collapsible table system is configured to operate as a table when the at least one pair of legs is extended, and the collapsible table system is configured to operate as a transport system when the at least one pair of legs is retracted.

In some embodiments, the at least one extension panel includes at least one extrusion extending from the at least one extension panel. In some instances, the horizontal storage bar includes at least one storage slot, where each of the storage slots is configured to receive one extrusion of the at least one extension panel. The at least one extension panel is detachably stored between the at least one pair of legs when each extrusion is received within one storage slot. In some instances, at least one vertical edge of the table top includes at least one attachment slot, where each attachment slot is configured to receive one extrusion of the at least one extension panel. The at least one extension panel is detachably coupled to the at least one vertical table edge in a horizontal orientation when each extrusion is received within one attachment slot. In some instances, a horizontal table top face includes at least one attachment slot, where each attachment slot is configured to receive one extrusion of the at least one extension panel. The at least one extension panel is detachably coupled to the horizontal table top face in a vertical orientation when each extrusion is received within one attachment slot.

In yet another aspect of the present disclosure, there is provided a method of reversibly converting a table into a transport system. The method includes first providing a collapsible table system with a table top, at least one pair of legs that pivotably extend from an underside of the table top, and at least one extension panel. The at least one extension panel is positioned on a horizontal storage bar extending between the at least one pair of legs, so that at least one extrusion extending from the at least one extension panel is received within a storage slot of the horizontal storage bar. When the at least one pair of legs is pivotably retracted, the collapsible table system becomes a transport system.

In some embodiments, the method further includes positioning at least one extension panel on a horizontal table top face in a vertical orientation, so that at least one extrusion extending from the at least one extension panel is received within an attachment slot of the horizontal table top surface and the transport system operates as a dolly transport system. In some embodiments, the table top includes a handgrip on a horizontal table top face and at least one wheel extending horizontally from a first vertical table edge. The handgrip is located near a second vertical table edge that is parallel to the first vertical table edge. In these embodiments, the method further includes pulling the handgrip after the collapsible table system becomes the transport system, so that the transport system is rolled along a surface by the at least one wheel.

A further understanding of the nature and advantages of the present invention will be realized by reference to the remaining portions of the specification and the drawings.

BRIEF DESCRIPTION OF DRAWINGS

The present disclosure same can be better understood, by way of example only, with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION OF THE INVENTION

The present invention is generally directed to a collapsible table system with detachable extension panels. The table system includes a table top, legs extending from and below the table top, and at least one extension panel. The extension panels are configured to be detachably coupled to table edges or the table top as shelves. For storage, the extension panels are configured to be detachably coupled to storage regions between pairs of table legs. The collapsible table may be configured as a table with or without shelves or stored as a transportable system with or without shelves. FIGS. 1 through 7 depict the table without extension panels from different views and in both upright and collapsed configurations. FIGS. 8 through 12 depict the collapsible table system with extension panels coupled as shelves or stored and in both upright and collapsed configurations.

Figure 1:
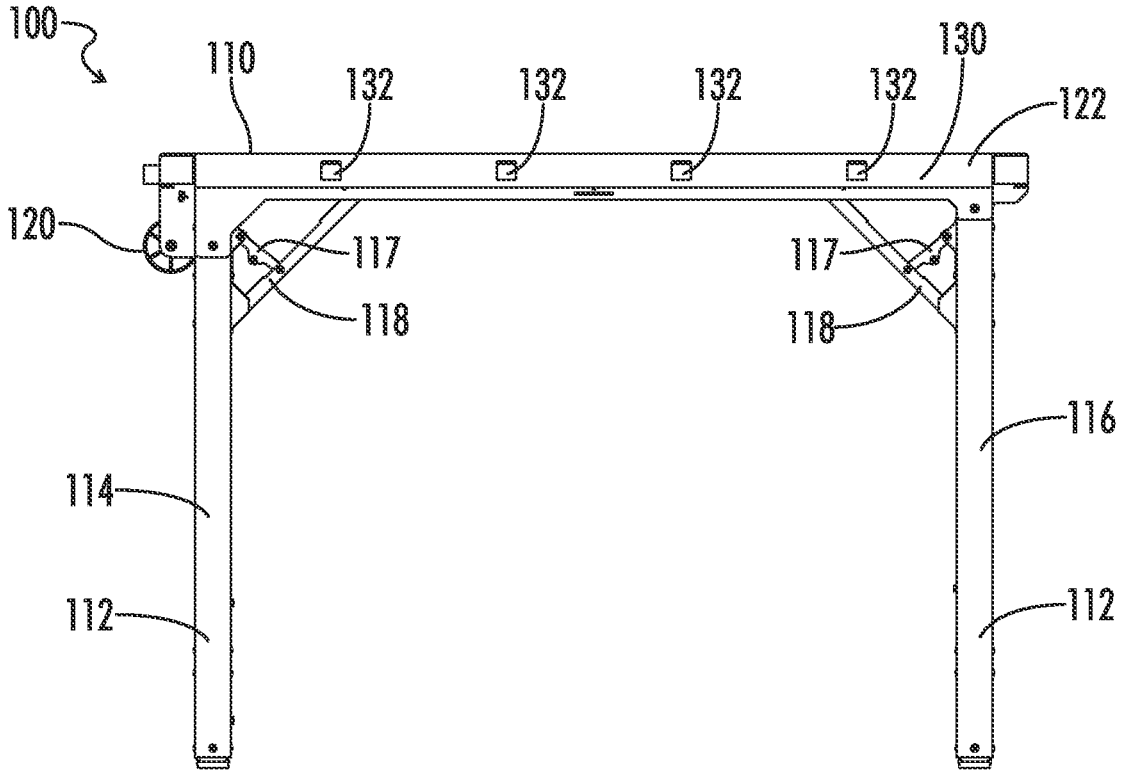
FIG. 1 is a first side view of the collapsible table of the present disclosure.

Referring to FIG. 1, there is depicted a collapsible table 100 of the collapsible table system 150. Table 100 includes a table top 110 that occupies a plane that is parallel with its support surface, which may be a natural surface such as grass, earth, sand, or stone, or a man-made surface such as concrete, turf, or asphalt. Table top 110 includes an upper table top face and an underside, from which legs 112 pivotably extend. Table top 110 further includes vertical table edges 130 that form the perimeter of table top 110. In the depicted embodiment, table top 110 is in the shape of a rectangle, but other shapes, such as squares, ovals, circles, quadrilaterals, hexagons, and octagons, are compatible with the present disclosure. Similarly, while vertical table edges 130 meet in corners in the depicted embodiment, rounded corners or edges are compatible with the present disclosure. The length, width, and depth of table top 110 vary in embodiments not depicted.

Figure 2:
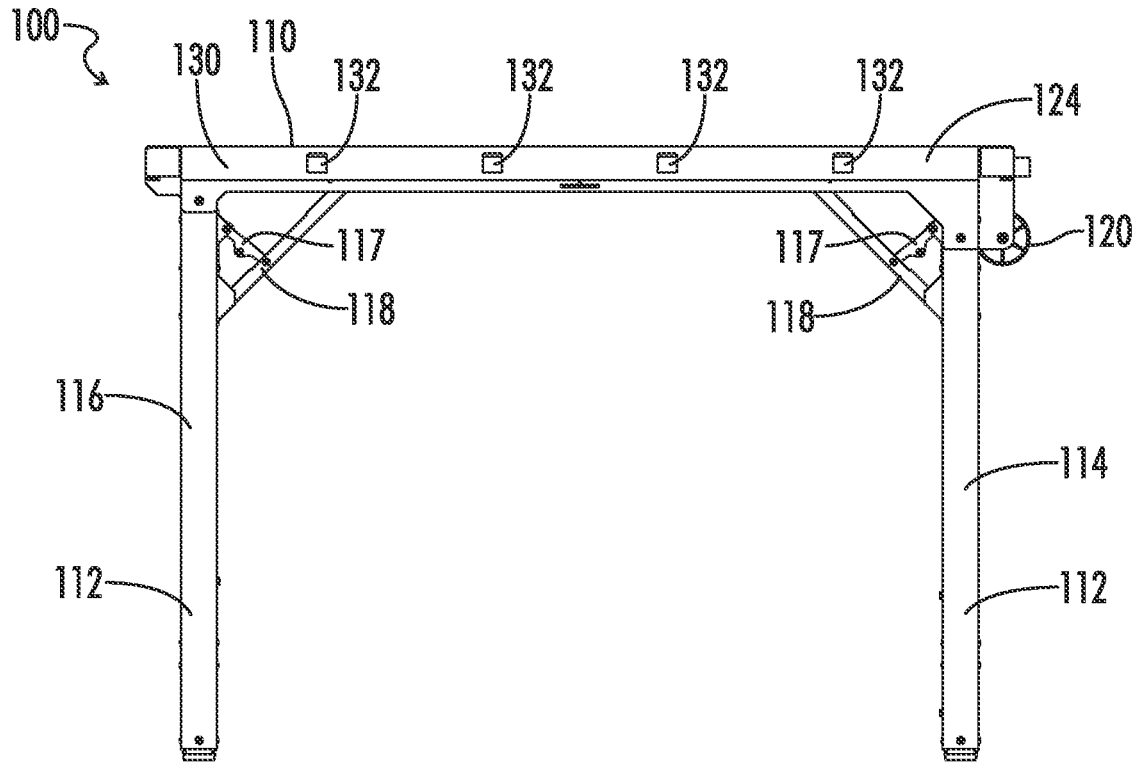
FIG. 2 depicts a second side view of the collapsible table of FIG. 1.

In FIG. 1, a plurality of vertical table edges 130 are present, with a first vertical table edge 122 shown spanning the length of table top 110 and a parallel second vertical table edge 124 that is not visible. Also present but not visible in the view on FIG. 2 are third vertical table edge 126 and fourth vertical table edge 128, which span the width of table top 110 and are perpendicular to first and second vertical table edges 122, 124, respectively. Table legs 112 are shown extending beneath table top 110 and have a height, length, and width that vary based on application. In some cases, legs 112 are telescoping or otherwise reversibly extendable in height from the support surface. In the depicted embodiment, legs 112 are present in a plurality of pairs of legs, with a first pair of legs 114 extending below the third vertical table edge 126 and a second pair of legs 116 extending below the fourth vertical table edge 128. However, other numbers of legs or pairs of legs are compatible with the present disclosure such that legs 112 support table top 110 and are configured to be retracted.

Each leg 112 or pair of legs is configured to be reversibly extended or retracted by folding leg brackets 118. When placed in an extended position, legs 112 extend perpendicular to table top 110. For storage and transport, legs 112 are configured to fold inward towards table top 110 at leg brackets 118. While legs 112 retract by folding in the depicted embodiment, other retraction features or means are compatible with the present disclosure, such that legs 112 enter a retracted or folded position. Leg brackets 118 prevent folding when legs 112 are extended by locking legs 112 into the extended position. The locking feature of leg brackets 118 is shown in FIG. 1 as a short segment 117 of leg brackets 118 that is positioned perpendicular to the longer segment when legs 112 are fully extended. A user adjusts leg bracket 118 to unlock it, such as by applying force, pressing a spring-loaded and/or telescoping peg through a hole or tab, or repositioning short segment 117 of leg bracket 118. Other locking and unlocking means are known in the art and are compatible with the present disclosure.

Table 100 further includes at least one wheel 120 located near and extending horizontally from a vertical table edge 130. In FIG. 1, two wheels 120 extend from third vertical table edge 126, though other numbers and locations of wheels are compatible with the present disclosure. Wheels 120 are configured to roll along a support surface and transport table 100 or collapsible table system 150 when legs 112 are retracted.

Located on vertical table edges 130 are a plurality of attachment slots 132 configured to receive extrusions 148 of extension panels 142, as is described below in greater detail. Attachment slots 132 are depicted as quadrilaterals, though other shapes, such as ovals, squares, circles, and trapezoids are compatible with the present disclosure. Further, attachment slots 132 are depicted as having sharp corners, though other corner shapes, such as fillet, circular, and chamfer corners are compatible with the present disclosure. Four attachment slots 132 are depicted, though other numbers, spacings, and sizes of attachment slots 132 are possible, such that extension panels 142 may be reversibly coupled to table 100. First vertical table edge 122 is shown with four attachment slots 132 that are evenly spaced.

In FIG. 2, a second side view of table 100 is shown, with second vertical table edge 124 visible. First vertical table edge 122 is not visible from this view, and is located parallel to second vertical table edge 124. Second vertical table edge 124 is shown with four attachment slots 132 that are evenly spaced. However, other numbers and spacings of attachment slots 132 are possible.

Figure 3:
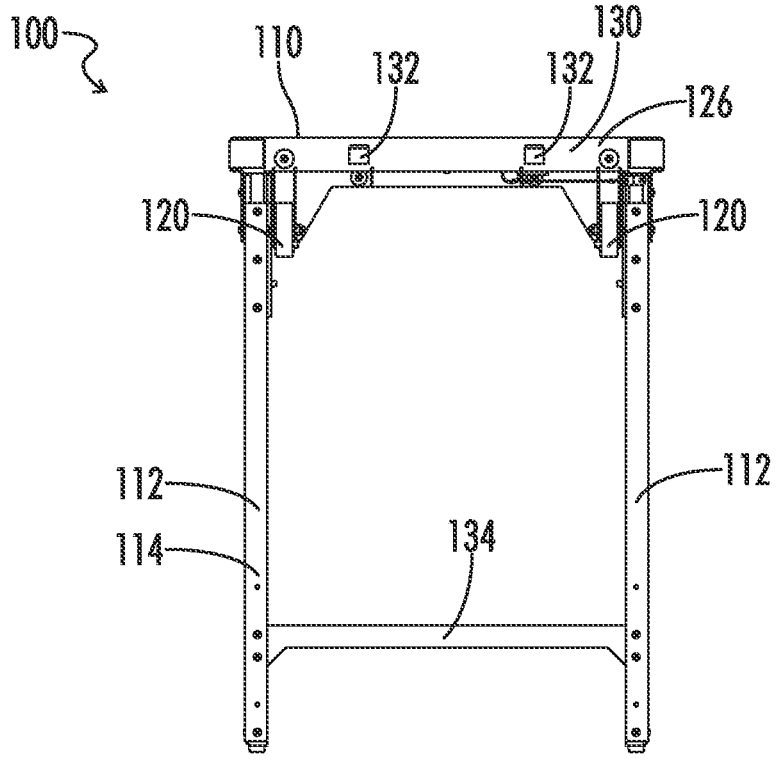
FIG. 3 depicts a back view of the collapsible table of FIG. 1.

In FIG. 3, a back view of table 100 is shown, with third vertical table edge 126 visible. Fourth vertical table edge 128 is not visible from this view, and is located parallel to third vertical table edge 126. Two wheels 120 are connected to table 100 below table top 110 and near third vertical table edge 126. The number, size, and spacing of wheels 120 vary based on application. First pair of legs 114 extends below third vertical table edge 126, with a storage bar 134 extending horizontally between first pair of legs 114. The height of storage bar 134 varies based on application, and different heights and widths of storage bar 134 are compatible with the present disclosure such that an extension panel 142 may rest on storage bar 134 and between first pair of legs 114. Third vertical table edge 126 is shown with two attachment slots 132 that are evenly spaced. However, other numbers and spacings of attachment slots 132 are possible.

Figure 4:
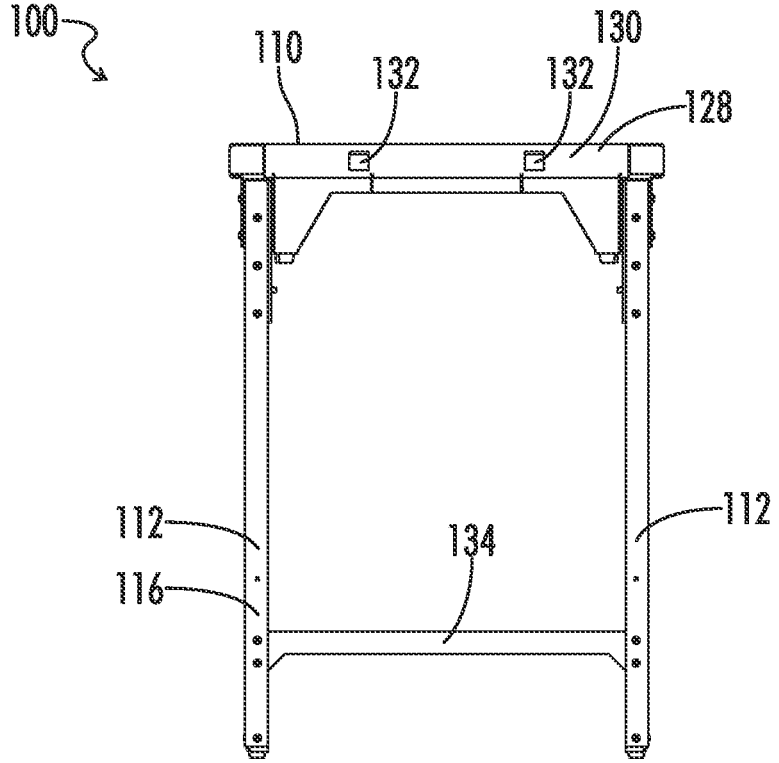
FIG. 4 depicts a front view of the collapsible table of FIG. 1.

In FIG. 4, a front view of table 100 is shown, with fourth vertical table edge 128 visible. Third vertical table edge 126 is not visible from this view, and is located parallel to fourth vertical table edge 128. Second pair of legs 116 extends below fourth vertical table edge 128, with a storage bar 134 extending horizontally between second pair of legs 116. The height of storage bar 134 varies based on application, and different heights and widths of storage bar 134 are compatible with the present disclosure such that an extension panel 142 may rest on storage bar 134 and between second pair of legs 116. Fourth vertical table edge 128 is shown with two attachment slots 132 that are evenly spaced. However, other numbers and spacings of attachment slots 132 are possible.

Figure 5:
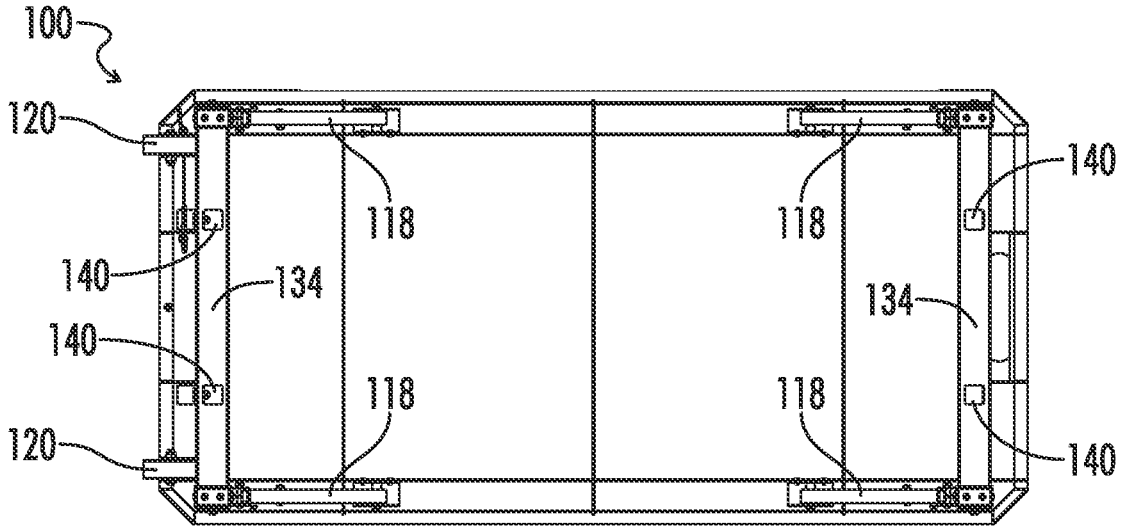
FIG. 5 depicts a bottom view of the collapsible table of FIG. 1.

Now referring to FIG. 5, a bottom view of table 100 is depicted, with storage bars 134 spanning first pair of legs 114 and second pair of legs 116. A plurality of storage slots 140 are located on storage bars 134 and configured to receive extrusions 148 of extension panels 142 as is described below in greater detail. Storage slots 140 are depicted as quadrilaterals, though other shapes, such as ovals, squares, circles, and trapezoids are compatible with the present disclosure. Further, storage slots 140 are depicted as having sharp corners, though other corner shapes, such as fillet, circular, and chamfer corners are compatible with the present disclosure. Two storage slots 140 are depicted on each storage bar 134, though other numbers, spacings, and sizes of storage slots 140 are possible, such that extension panels 142 may be reversibly coupled to storage bars 134.

Figure 6:
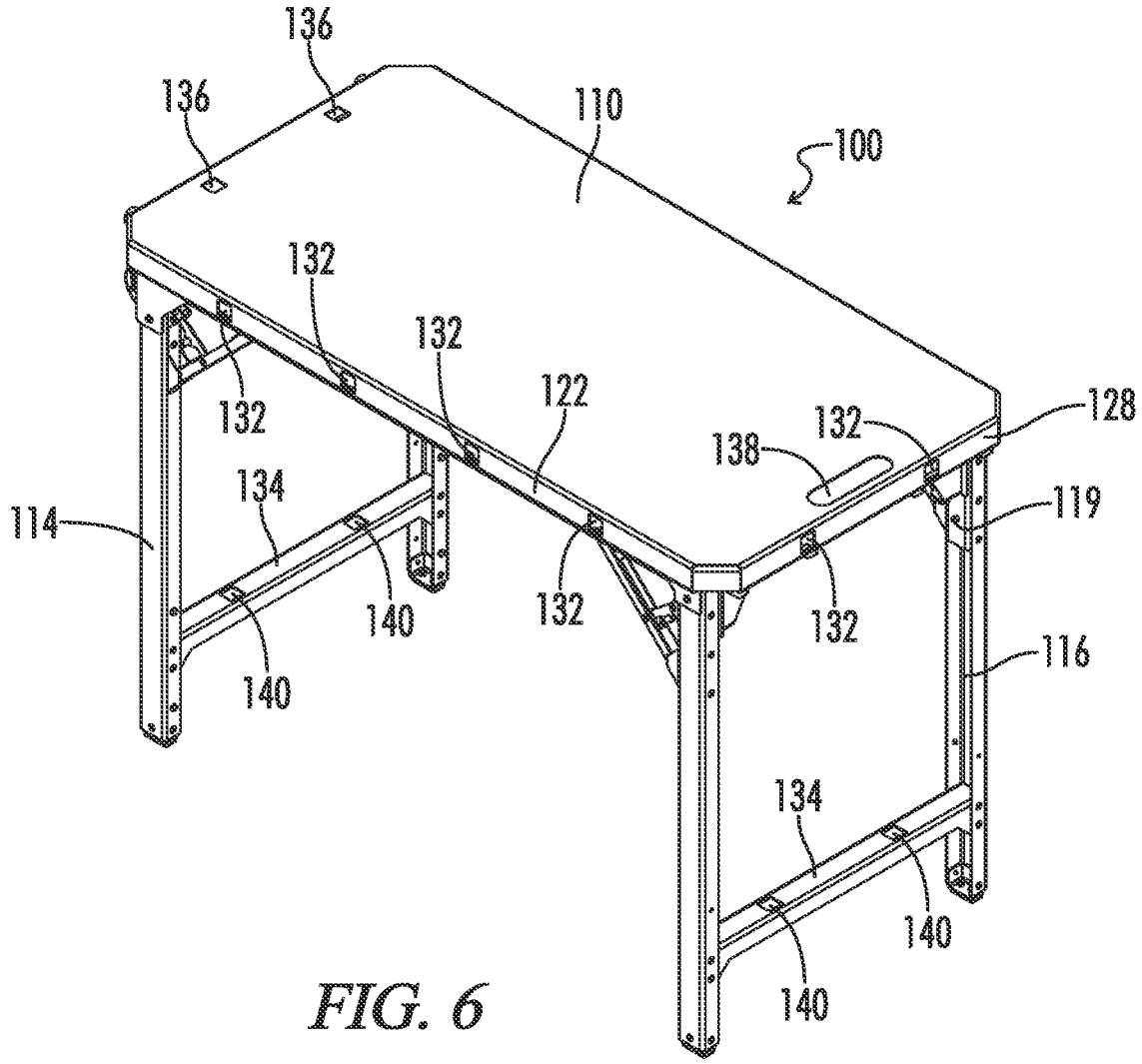
FIG. 6 depicts a top perspective view of the collapsible table of FIG. 1 in an unfolded configuration.

In FIG. 6, a top perspective view of table 100 is shown, with table top attachment slots 136 and handgrip 138 visible on the upper table top face. The plurality of table top attachment slots 136 are located on the horizontal table top face nearest third vertical table edge 126, though other locations are compatible with the present disclosure. Plurality of table top attachment slots 136 are configured to receive extrusions 148 of extension panels 142 as is described below in greater detail. Table top attachment slots 136 are depicted as quadrilaterals, though other shapes, such as ovals, squares, circles, and trapezoids are compatible with the present disclosure. Further, table top attachment slots 136 are depicted as having sharp corners, though other corner shapes, such as fillet, circular, and chamfer corners are compatible with the present disclosure. Two table top attachment slots 136 are depicted, though other numbers, spacings, and sizes of table top attachment slots 136 are possible, such that extension panels 142 may be reversibly coupled to table 100.

Handgrip 138 is for gripping table 100 or table system 150 and pulling or transporting same. The shape of handgrip 138 is shown as a rounded quadrilateral or oval, though other shapes and sizes are compatible with the present disclosure such that a user's hand fits within handgrip 138. In embodiments not depicted, handgrip 138 is a handle, strap, knob, or other gripping means. Handgrip 138 is located on the horizontal table top face nearest fourth vertical table edge 128, though other locations are compatible with the present disclosure. In preferred embodiments, handgrip 138 is located near a vertical table edge that is opposite the nearest vertical table edge to at least one wheel 120. In such a manner, when legs 112 are retracted, a user may grip handgrip 138 and pull table 100 or table system 150 such that it rolls along a support surface using at least one wheel 120. Thus, table 100 or table system 150 is transportable when legs 112 are retracted. As described below in greater detail, table system 150 operates as a dolly transport system when an extension panel 142 is detachably coupled to table top attachment slots 136 and legs 112 are retracted.

Also depicted in FIG. 6 is at least one locking peg 119 for locking an extension panel 142 into place for storage, as is described below in greater detail. Locking pegs 119 are located on upper sections of interior faces of each leg 112 in the depicted embodiment. However, the number and positions of locking pegs 119 varies in embodiments not depicted. The locations and numbers of locking pegs 119 are such that locking pegs 119 align with locking holes 121 of extension panels 142 when extension panels 142 are positioned for storage. Each of first pair of legs 114 and second pair of legs 116 includes at least one locking peg 119.

Figure 7:
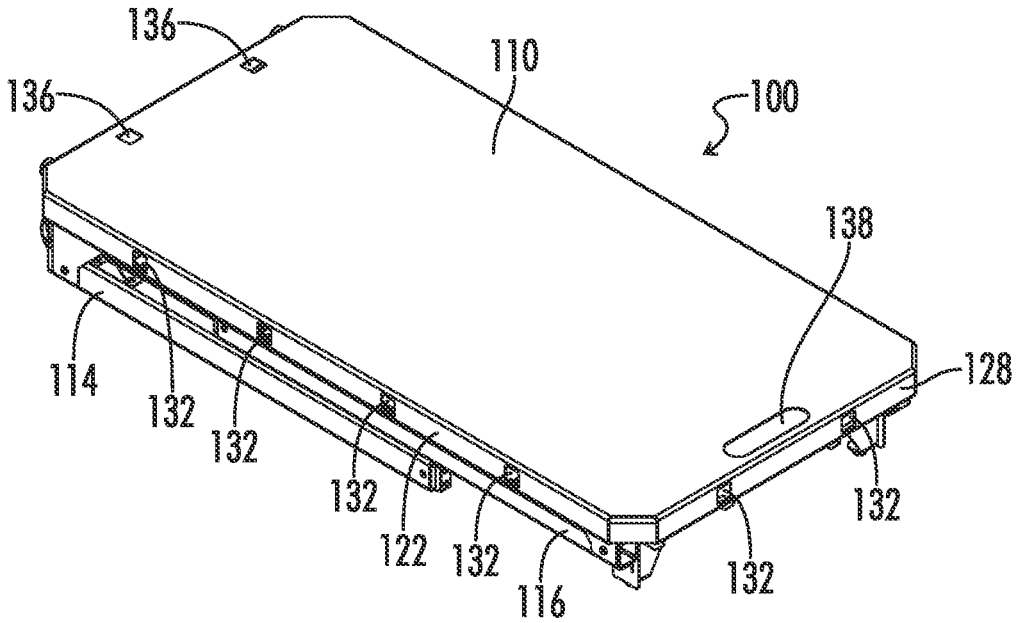
FIG. 7 depicts a top perspective view of the collapsible table of FIG. 1 in a folded configuration.

Referring now to FIG. 7, a retracted configuration of table 100 is depicted, with legs 112 retracted and stored beneath table top 100. In such a configuration, at least one wheel 120 is configured to contact the support surface when a user lifts table 100 with handgrip 138. When the user pulls handgrip 138, at least one wheel 120 rolls table 100 along the surface, allowing the transport of table 100. The stowed or retracted configuration of table 100 reduces the space that table 100 occupies, facilitating its storage. While first pair of legs 114 is shown folded below second pair of legs 116, the folding order is reversed in other instances. Retraction of legs 112 is reversible.

Figure 8:
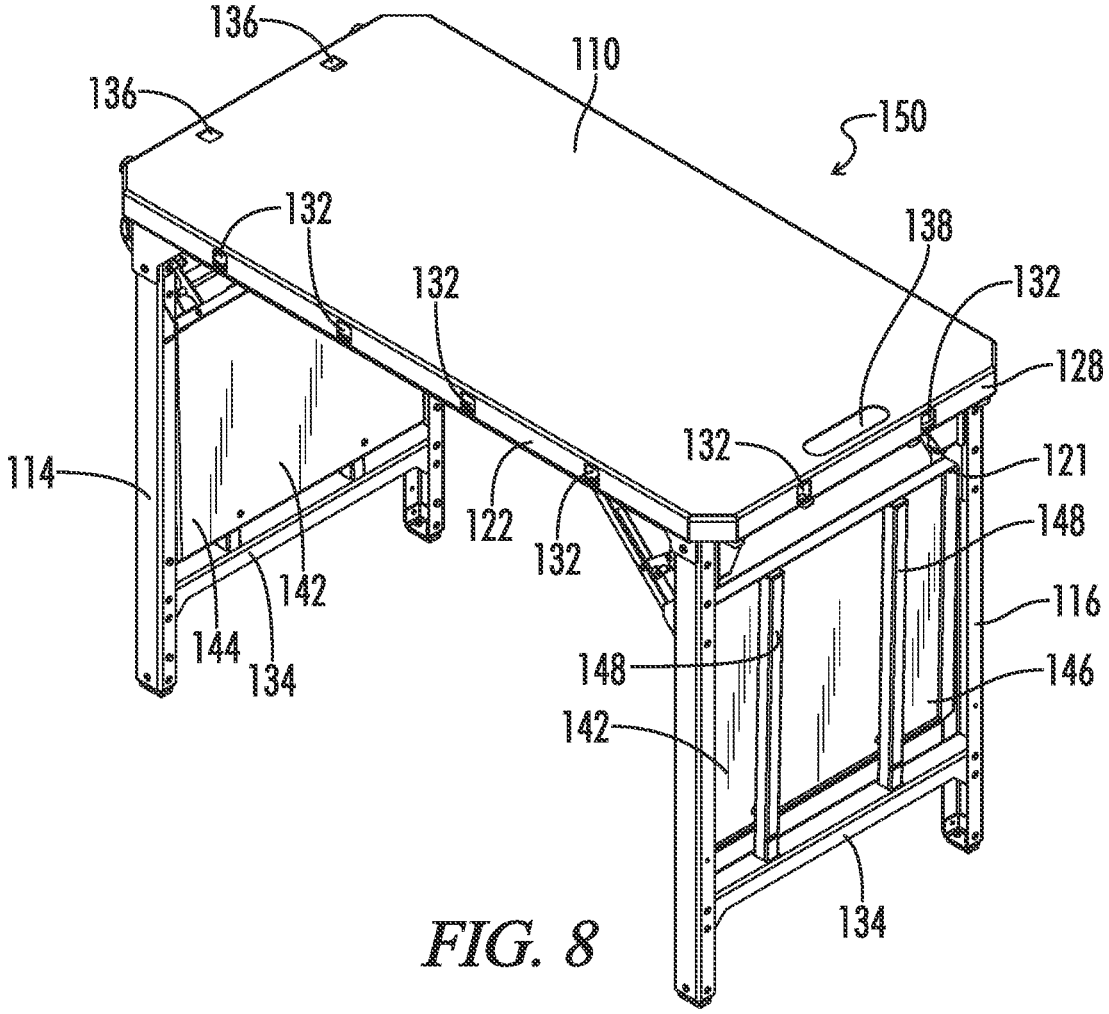
FIG. 8 depicts a top perspective view of the collapsible table system of the present disclosure with extension panels stowed within the collapsible table of FIG. 1.

In FIG. 8, collapsible table system 150 is shown, with table 100 and at least one extension panel 142. Table is shown with legs 112 extended and with extension panels 142 stored between each pair of legs. While two extension panels 142 are depicted, more or less extension panels are compatible with the present disclosure. For instance, 0, 1, 2, 3, 4, or 6 extension panels 142 may be included in table system 150. Extension panels 142 are depicted as square shaped, though other shapes, such as quadrilaterals, trapezoids, triangles, hexagons, and octagons are compatible with the present disclosure such that extension panels 142 may be detachably coupled to storage slots 140, attachment slots 132, or table top attachment slots 136. Sizes of extension panels 142 vary with different applications.

Extension panels 142 further include at least one extrusion 148 that extends beyond at least one edge of the extension panel 142. The shape, size, and spacings of extrusions 148 vary and are compatible with other slots, such that extrusions 148 are configured to align with and fit snugly within storage slots 140, attachment slots 132, and table top attachment slots 136. Each extrusion 148 is configured to be detachably coupled to one storage slot 140, attachment slot 132, or table top attachment slot 136.

Extension panels 142 include at least one locking hole 121 on at least on side that does not have extrusions 148. Locking holes 121 are sized and positioned to align with locking pegs 119 of legs 112 when extension panel 142 is positioned for storage. The number and position of locking holes 121 varies for different embodiments, and any number or position of locking holes 121 are compatible with the present disclosure such that they may be aligned with locking pegs 119. Each extension panel 142 includes at least on locking hole 121.

In FIG. 8, two extrusions 148 extend across each extension panel 142. However, other numbers of extrusions 148 and locations are possible. Extrusions 148 are depicted as being detachably coupled to storage slots 140 of storage bars 134, such that extension panels 142 are stored above each storage bar 134 between each pair of legs. Similarly, locking holes 121 are depicted as being detachably coupled to locking pegs 119 of legs 112, such that extension panels 142 are stored above each storage bar 134 between each pair of legs. To lock into place, locking peg 119 is positioned within locking hole 121, either by spring-loaded and/or telescoping motion of locking peg 119, pressure by a user, or both. In such a stored configuration, extension panels 142 are configured to be folded with legs 112 when legs 112 are retracted. Extension panels 142 are removed from the stored configuration by removing locking peg 119 from locking hole 121 and then removing extrusions 148 from storage slots 140. The unlocking includes a user applying pressure to locking peg 119, pressing a switch to release locking peg 119, or otherwise retracting locking peg 119 from locking hole 121.

Figure 9:
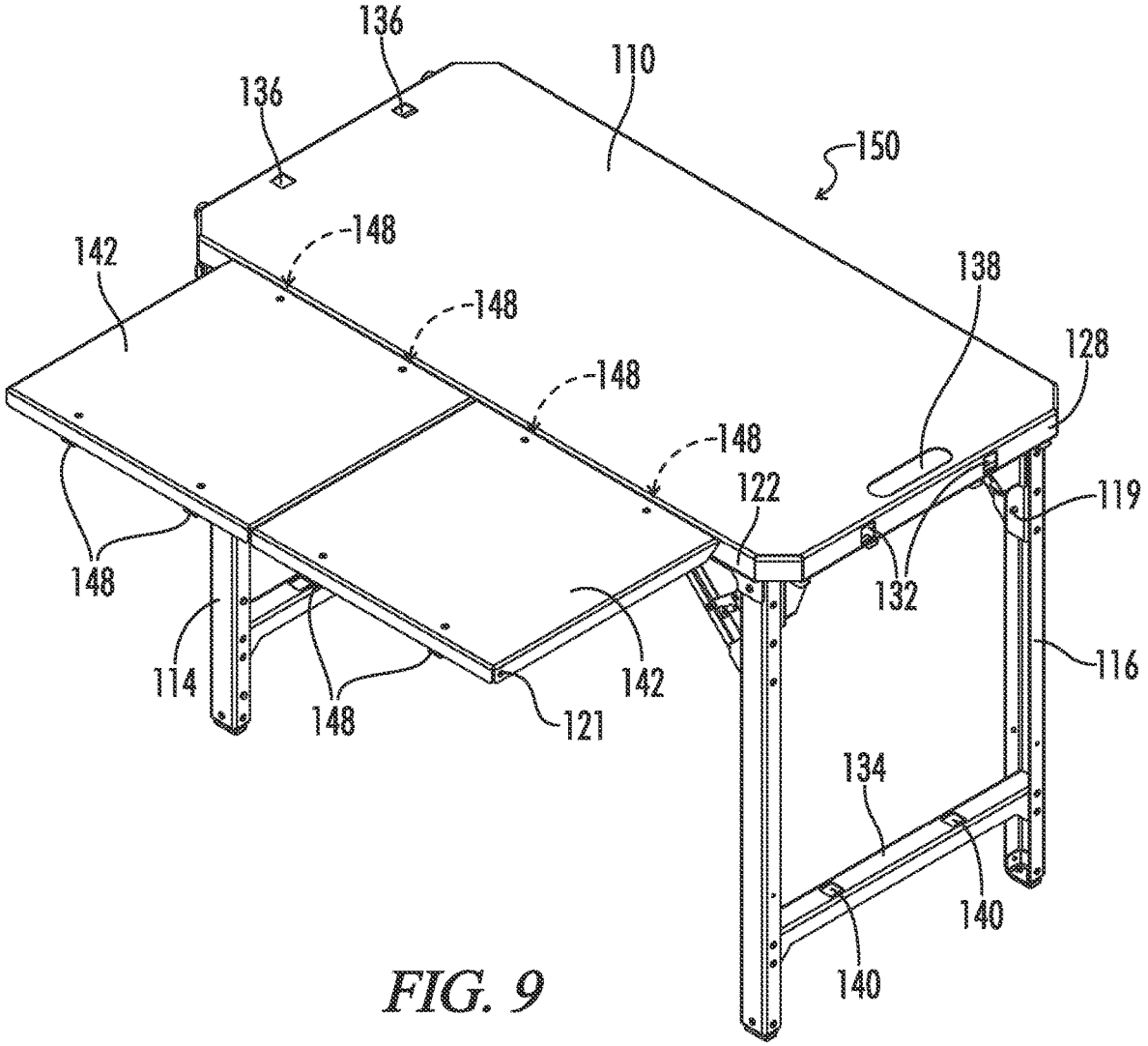
FIG. 9 depicts a top perspective view of the collapsible table system of FIG. 8 with two extension panels attached to a vertical table edge of the collapsible table in a shelf configuration.

FIG. 9 shows extension panels 142 in a shelf configuration and extending horizontally from a vertical table edge 130. While two panels 142 are depicted, different numbers of panels 142 are compatible such that they may be received within attachment slots 132. Extension panels 142 may be located on the same vertical table edge 130, as depicted, or on different vertical table edges 130. For attachment, a user couples the extension panels 142 to vertical table edge 130 by first inserting extrusions 148 at an angle to the attachment slots 132 and then lowering extension panels 142 to become parallel to table top 110. In such a manner, extension panels 142 are coupled to vertical table edge 130 and locked into position. When extension panels 142 are positioned horizontally, as depicted, they serve to extend the horizontal table top face and act as shelves. The coupling is detachable without a significant or destructive amount of force from the user. For detachment, a user lifts the edge of extension panel 142 that is opposite the edge coupled to vertical table edge 130, thus positioning extension panel 142 and extrusions 148 at an angle to table top 110 and attachment slots 132. In this angled position, extrusions 148 are unlocked and removable from attachment slots 132. Thus, a user may then remove extension panels 142 from vertical table edge 130.

Figure 10:
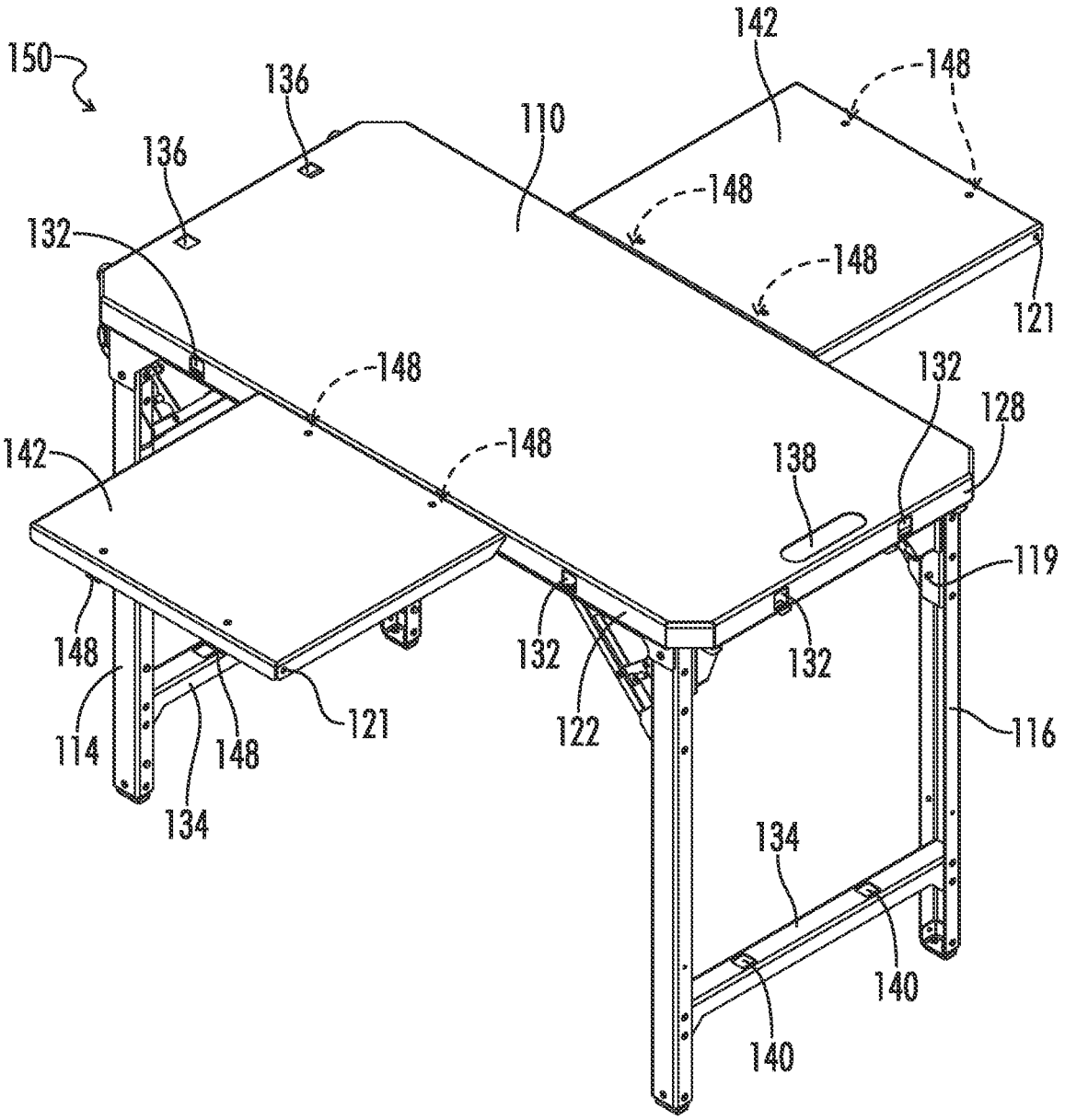
FIG. 10 depicts a top perspective view of the collapsible table system of FIG. 8 with an extension panel attached to each of two vertical table edges of the collapsible table in a shelf configuration.

FIG. 10 shows a different arrangement of extension panels 142 about vertical table edges 130, with one extension panel 142 attached to each of first vertical table edge 122 and second vertical table edge 124. However, other arrangements are possible. FIG. 10 also depicts extrusions 148 of each extension panel 142 occupying the middle of the four attachment slots 132 on each of first vertical table edge 122 and second vertical table edge 124. Any unoccupied attachment slots 132 which align with extrusions 148 are available for the attachment of extension panels 142.

Figure 11:
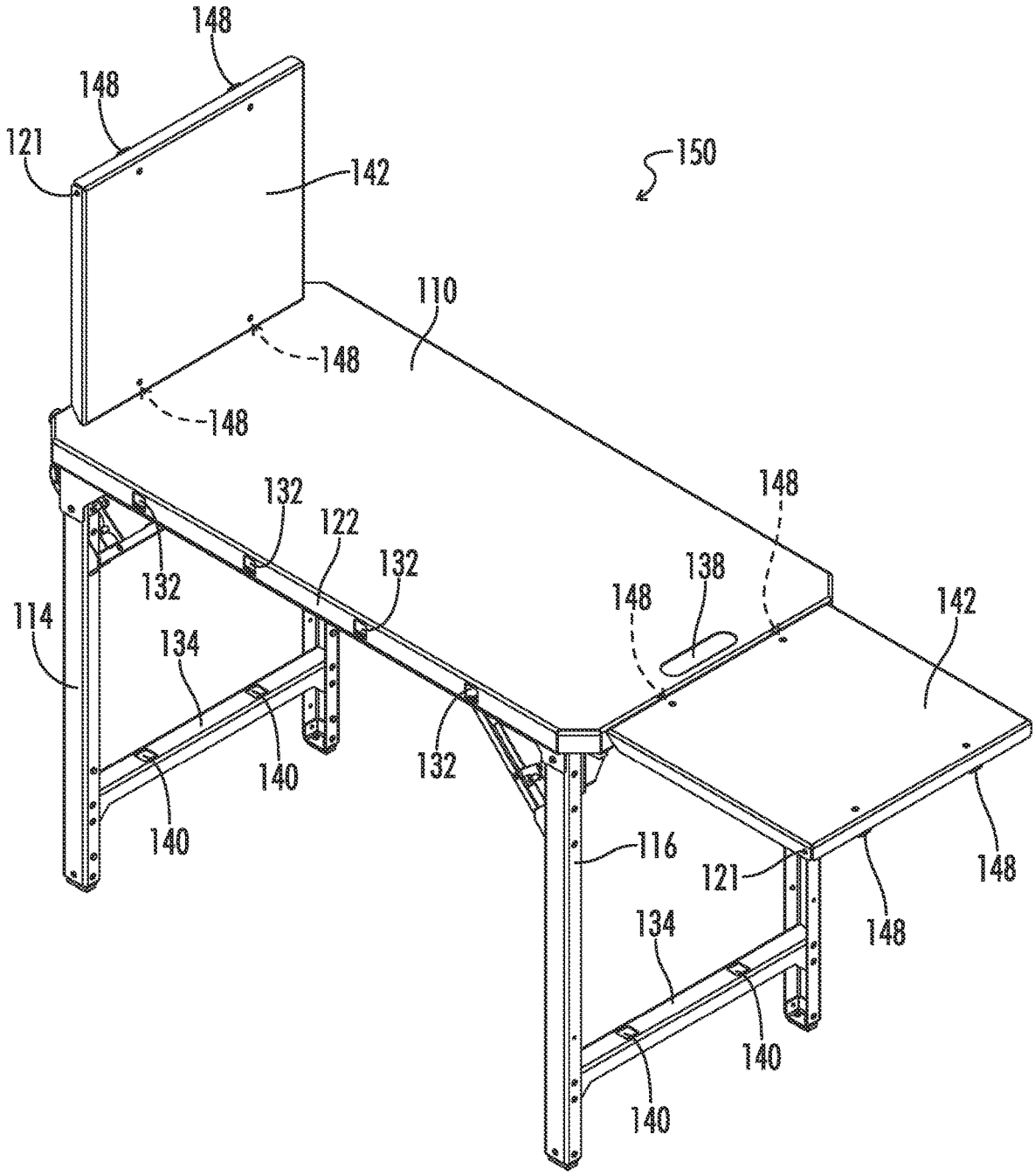
FIG. 11 depicts a top perspective view of the collapsible table system of FIG. 8 with an extension panel attached to each of a vertical table edge and the horizontal table top of the collapsible table in a shelf configuration.

FIG. 11 shows a combination of extension panels 142 in a horizontal and vertical position about table top 100. In a horizontal position, one extension panel 142 extends from two attachment slots 132 of fourth vertical table edge 128. In a vertical position, the other extension panel 142 extends from two table top attachment slots 136. For vertical position attachment, a user couples the extension panels 142 to table top 110 by first inserting extrusions 148 at an angle to the attachment slots 136 and then tilting extension panels 142 to become perpendicular to table top 110. In such a manner, extension panels 142 are coupled to table top 110 and locked into position. When an extension panel 142 is positioned vertically, as depicted, it serves as a boundary or side of table 100 and functions as a component of a dolly when legs 112 are retracted. The coupling is detachable without a significant or destructive amount of force from the user. For detachment, a user tilts the edge of extension panel 142 that is opposite the edge coupled to table top 110, thus positioning extension panel 142 and extrusions 148 at an angle to table top 110 and attachment slots 136. In this angled position, extrusions 148 are unlocked and removable from attachment slots 136. Thus, a user may then remove extension panels 142 from table top 110.

Figure 12:
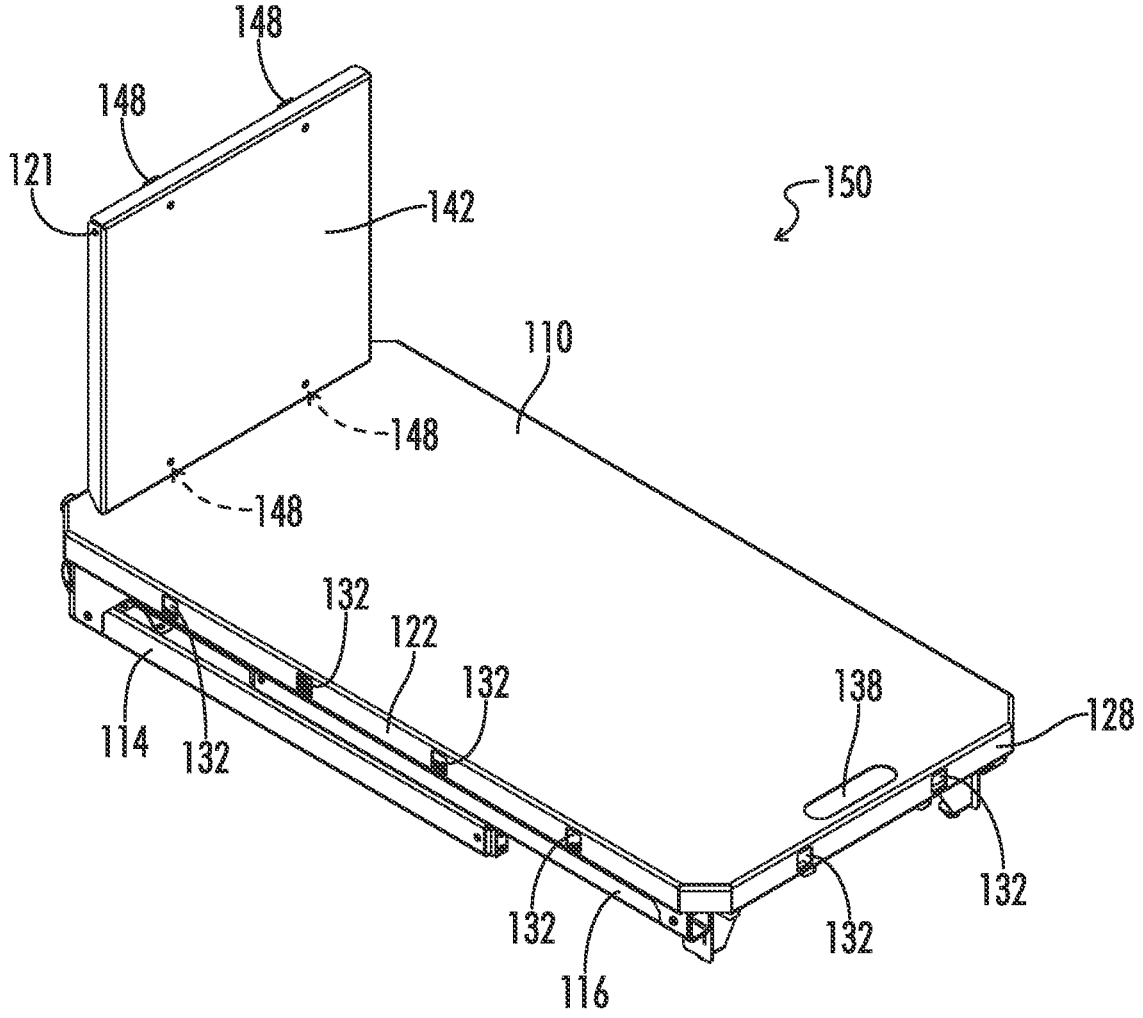
FIG. 12 depicts a top perspective view of the collapsible table system of FIG. 8 with an extension panel attached to the horizontal table top of the folded collapsible table in a travel configuration.

FIG. 12 shows a dolly transport system configuration of table system 150. In such a configuration, legs 112 retracted and stored beneath table top 100. At least one wheel 120 is configured to contact the support surface when a user lifts table system 150 with handgrip 138. When the user pulls handgrip 138, at least one wheel 120 rolls table system 150 along the surface, allowing the transport of table system 150. The stowed or retracted configuration of table system 150 reduces the space that table system 150 occupies, facilitating its storage. While first pair of legs 114 is shown folded below second pair of legs 116, the folding order is reversed in other instances. Retracted legs 112 are configured to be extended again as desired by the user.

In the dolly transport system configuration, at least one extension panel 142 is retained in a vertical position to form a lifting panel of the dolly. The weight of items to be lifted is such that extension panel 142 is not damaged or removed from table top attachment slots 136. The location of table top attachment slots 136 is preferably nearest the vertical table edge closest to the at least one wheel 120, such that any extension panel 142 attached to table top attachment slots 136 is located closest to the support surface when a user pulls handgrip 138. In such a location, an attached extension panel 142 serves as a shelf to support items when table system 150 is configured as a dolly transport system.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

I claim:

1. A collapsible table system comprising:

a collapsible table having a table top and at least one pair of legs pivotably extending from an underside of the table top; and at least one extension panel configured to be detachably stored between the at least one pair of legs when not in use as a shelf, configured to be detachably coupled to at least one vertical table edge of the table top in a horizontal orientation as a shelf, and configured to be detachably coupled to a horizontal table top face in a vertical orientation as a lifting panel, wherein the collapsible table system is configured to operate as a table when the at least one pair of legs is extended, and wherein the collapsible table system is configured to operate as a dolly transport system when the at least one pair of legs is retracted and the at least one extension panel is detachably coupled to the horizontal table top face in the vertical orientation to form the lifting panel.

2. The collapsible table of claim 1, wherein the at least one extension panel includes at least one extrusion extending from the at least one extension panel.

3. The collapsible table of claim 2, wherein the at least one pair of legs includes a horizontal storage bar extending between the at least one pair of legs and having at least one storage slot, each of the at least one storage slots configured to receive one extrusion of the at least one extension panel, such that the at least one extension panel is detachably stored between the at least one pair of legs when each extrusion is received within one storage slot.

4. The collapsible table of claim 2, wherein the at least one vertical edge of the table top includes at least one attachment slot, each of the at least one attachment slots configured to receive one extrusion of the at least one extension panel, such that the at least one extension panel is detachably coupled to the at least one vertical table edge in the horizontal orientation when each extrusion is received within one attachment slot.

5. The collapsible table of claim 2, wherein the horizontal table top face includes at least one attachment slot, each of the at least one attachment slots configured to receive one extrusion of the at least one extension panel, such that the at least one extension panel is detachably coupled to the horizontal table top face in the vertical orientation when each extrusion is received within one attachment slot.

6. The collapsible table of claim 1, wherein the table top includes a handgrip on its horizontal table top face and at least one wheel extending horizontally from a first vertical table edge, the handgrip located near a second vertical table edge that is parallel to the first vertical table edge.

7. The collapsible table of claim 6, wherein the at least one wheel is configured to roll the collapsible table system along a surface when collapsible table system is operated as the dolly transport system and a user pulls the handgrip.

8. The collapsible table of claim 1, wherein a first extension panel is configured to be detachably coupled to a first vertical table edge and a second extension panel is configured to be detachably coupled to a second vertical table edge.

9. The collapsible table of claim 1, wherein a first extension panel and a second extension panel are configured to be detachably coupled to a first vertical table edge.

10. The collapsible table of claim 1, wherein a first extension panel is configured to be detachably coupled to a first vertical table edge and a second extension panel is configured to be detachably coupled to the horizontal table top face.

11. A collapsible table system comprising:

a collapsible table having a table top and at least one pair of legs pivotably extending from an underside of the table top, the at least one pair of legs including a horizontal storage bar extending between the at least one pair of legs; and at least one extension panel configured to be detachably stored on the horizontal storage bar between the at least one pair of legs, wherein the collapsible table system is configured to operate as a table when the at least one pair of legs is extended, and wherein the collapsible table system is configured to operate as a dolly transport system when the at least one pair of legs is retracted and the at least one extension panel is detachably coupled to the table top in a vertical orientation to form a lifting panel portion of the dolly transport system.

12. The collapsible table of claim 11, wherein the at least one extension panel includes at least one extrusion extending from the at least one extension panel.

13. The collapsible table of claim 12, wherein the horizontal storage bar includes at least one storage slot, each of the at least one storage slots configured to receive one extrusion of the at least one extension panel, such that the at least one extension panel is detachably stored between the at least one pair of legs when each extrusion is received within one storage slot.

14. The collapsible table of claim 12, wherein at least one vertical edge of the table top includes at least one attachment slot, each of the at least one attachment slots configured to receive one extrusion of the at least one extension panel, such that the at least one extension panel is detachably coupled to the at least one vertical table edge in a horizontal orientation when each extrusion is received within one attachment slot.

15. The collapsible table of claim 12, wherein a horizontal table top face includes at least one attachment slot, each of the at least one attachment slots configured to receive one extrusion of the at least one extension panel, such that the at least one extension panel is detachably coupled to the horizontal table top face in a vertical orientation when each extrusion is received within one attachment slot.

16. A method of reversibly converting a table into a transport system, the method including:

providing a collapsible table system, the collapsible table system including a table top, at least one pair of legs pivotably extending from an underside of the table top, and at least one extension panel detachably coupled to and extending horizontally from an edge of the table top;

converting the collapsible table system into a dolly transport system by pivotably retracting the at least one pair of legs, detaching the at least one extension panel from the edge of the table top and detachably coupling the at least one extension panel to a top surface of the table top in a vertical orientation to form a lifting panel portion of the dolly transport system.

17. The method of claim 16, further including positioning at least one extrusion extending from the at least one extension panel within an attachment slot of the table top.

18. The method of claim 16, wherein the table top includes a handgrip on a horizontal table top face and at least one wheel extending horizontally from a first vertical table edge, the handgrip located near a second vertical table edge that is parallel to the first vertical table edge.

19. The method of claim 18, further including pulling the handgrip after the collapsible table system becomes the dolly transport system, such that the dolly transport system is rolled along a surface by the at least one wheel.

20. A collapsible table system comprising:

a collapsible table having a table top and at least one pair of legs pivotably extending from an underside of the table top; and at least one extension panel configured to be detachably coupled to at least one vertical table edge of the table top in a horizontal orientation as a shelf and configured to be detachably coupled to a horizontal table top face in a vertical orientation as a lifting panel, wherein the collapsible table system is convertible between a table configuration which includes the at least one pair of legs extended and the at least one extension panel detachably coupled to the at least one vertical table edge of the table top in the horizontal orientation to form the shelf and a dolly transport system configuration including the at least one pair of legs is retracted and the at least one extension panel detachably coupled to the horizontal table top face in the vertical orientation to form the lifting panel.

* * * * *